United States Patent [19]

Suda et al.

[11] Patent Number: 5,063,117

[45] Date of Patent: Nov. 5, 1991

[54] COPPER FIN MATERIAL FOR HEAT-EXCHANGER AND METHOD OF PRODUCING THE SAME

[75] Inventors: Hideo Suda, Imaichi; Norimasa Sato, Utsunomiya; Katsuhiko Takada, Anjo; Sumio Susa, Anjo; Yasushi Aiyoshizawa, Nikko; Kenichi Omata, Imaichi, all of Japan

[73] Assignees: The Furukawa Electric Co., Ltd., Tokyo; Nippondenso Co., Ltd., Kariya, both of Japan

[21] Appl. No.: 454,460

[22] Filed: Dec. 21, 1989

[30] Foreign Application Priority Data

| | | | |
|---|---|---|---|
| Dec. 27, 1988 | [JP] | Japan | 63-327697 |
| Jan. 30, 1989 | [JP] | Japan | 1-20275 |
| Mar. 1, 1989 | [JP] | Japan | 1-49177 |
| Mar. 1, 1989 | [JP] | Japan | 1-49178 |

[51] Int. Cl.[5] ..... B32B 15/01

[52] U.S. Cl. ..... 428/610; 428/674; 428/675

[58] Field of Search ..... 428/610, 658, 674, 675

[56] References Cited

FOREIGN PATENT DOCUMENTS

| | | | |
|---|---|---|---|
| 58-45396 | 3/1983 | Japan . | |
| 61-6290 | 1/1986 | Japan . | |
| 61-110794 | 5/1986 | Japan . | |
| 62-44594 | 2/1987 | Japan . | |
| 284062 | 12/1987 | Japan | 428/610 |
| 65278 | 3/1989 | Japan | 428/610 |

*Primary Examiner*—R. Dean
*Assistant Examiner*—George Wyszomierski
*Attorney, Agent, or Firm*—Oblon, Spivak, McClelland, Maier & Neustadt

[57] ABSTRACT

A copper fin material for heat-exchanger characterized in that, on the surface of Cu or Cu alloy strip, the formation of an inner side diffused layer comprising Cu and Zn and a surface side diffused layer being provided on the surface side thereof and comprising Cu, Zn and elements with a lower diffusion coefficient into Cu than that of Zn is disclosed. A method of producing the same is characterized in that, after an alloy film comprising elements with a lower diffusion coefficient into Cu than that of Zn and Zn was formed on the surface of Cu or Cu alloy strip, a diffusion treatment is given under heat so that, on the surface of Cu or Cu alloy strip, an inner side diffused layer comprising Cu and Zn and a surface side diffused layer being provided on the surface side thereof and comprising Cu, Zn and elements with a lower diffusion coefficient into Cu than that of Zn are formed, or the diffusion treatment under heat and the rolling processing are given.

4 Claims, 2 Drawing Sheets

COPPER FIN MATERIAL FOR HEAT-EXCHANGER AND METHOD OF PRODUCING THE SAME

BACKGROUND OF THE INVENTION

The present invention relates to a copper fin material for heat-exchanger suitable for the heat-exchanger to be used under the severe conditions of corrosive environment of cars etc. and a method producing the same. It has made it possible in particular, to improve the corrosion resistance and to thin the fin without decreasing the thermal conductivity as a fin.

Recently, a trend in thinning the fin material for heat-exchanger has been accompanied by the lightening in weight of heat-exchanger for cars. While, on the otherhand, the corrosion due to the salt damage caused by snow-melting material etc. has become a problem The severe corrosion of fin material due to salt damage is affecting seriously on the heat-exchanger in such ways as the decrease in the radiating characteristics, the deterioration in the strength and the like.

In general, improvements in the strength, corrosion resistance, etc. are all desired for the fin material for heat-exchanger. With respect to the improvement in the corrosion resistance, the improvement is possible even by alloying the material itself through the addition of second and third elements as, for example, Cu-Ni type anticorrosive alloy. This brings about, however, not only an increase in cost resulting in the economical disadvantage, but also a drastic decrease in thermal conductivity (electroconductivity). Hence, even if the fin material may be excellent in the aspect of corrosion resistance, it ends up to become quite unsuitable as a fin material for heat-exchanger, high electroconductivity being desired therefor.

On the otherhand, the corrosion is originally a phenomenon on the surface. Thus, if deciding to modify only the surface of material, it should also be possible to suppress the decrease in the electroconductivity to a low degree and yet to improve the corrosion resistance. Based on this thought, a fin material for heat-exchanger having a diffused layer of Zn formed on the surface of highly electroconductive copper-based material, protecting the inside core material by a mode of sacrificial anode, and retaining the electroconductivity by the core material has been proposed, for example, as a fin material for car radiator. In fact, a distinct effect on the improvement in the corrosion resistance can be seen by forming the diffused layer of Zn on the surface, but, the diffused layer of Zn formed on the surface layer is restricted to several $\mu$m or so per side in thickness and that, in this case, the surface becomes a Cu-Zn alloy, so-called brass, there is a problem that the Zn disappears through the dezincificative corrosion inherent to brass, and thus, the sacrificial anode effect of Zn cannot be retained over a long term.

As described above, although the diffused layer of Zn formed on the surface layer is restricted to several $\mu$m or so per side in thickness, if the dezincificative corrosion inherent to brass can be suppressed and prevented effectively, the fin material for heat-exchanger more excellent in the corrosion resistance could be expected and the thinning would also become possible.

In order to suppress such dezincificative corrosion inherent to brass, a method is conceivable wherein third element effective on the improvement in the corrosion resistance is added into the diffused layer of Cu-Zn for making the Zn-diffused layer itself highly corrosion-resistant.

Various elements can be considered for suppressing the dezincificative corrosion. However, the decrease in the thermal conductivity when adding these elements to copper ends up generally becoming large compared with that when adding same amount of Zn. Hence, if these elements are added to the entire diffused layer in a sufficient amount to suppress and prevent effectively the dezincificative corrosion etc., the corrosion resistance would be improved, but the decrease in the thermal conductivity would end up becoming large.

As a result of extensive investigations in view of this situation, a copper fin material for heat-exchanger excellent in the corrosion resistance and the thermal conductivity and a method of producing the same have been developed according to the invention, wherein the dezincificative corrosion of Zn-diffused layer formed on the surface of Cu or Cu alloy strip is alleviated and the decrease in the thermal conductivity arising from the addition of third element into Zn-diffused layer is lessened.

SUMMARY OF THE INVENTION

A copper fin material for heat-exchanger of the present invention is characterized in that, on the surface of Cu or Cu alloy strip, an inner side diffused layer comprising Cu and Zn and a surface side diffused layer being provided on the surface side thereof and comprising Cu, Zn and elements with a lower diffusion coefficient into Cu than that of Zn are formed.

Moreover, another copper fin material for heat-exchanger of the present invention is characterized in that, on- the surface of heat-constructing copper strip containing one or more selected from the group consisting of of Mg, Zn, Sn, Cd, Ag, Ni, P, Zr, Cr, Pb and Al in total amounts of 0.01 to 0.13 wt. %, the remainder being Cu, and having an electroconductivity of not lower than 90% IACS, an inner side diffused layer comprising Cu and Zn and a surface side diffused layer being provided on the surface side thereof and comprising Cu, Zn and elements with a lower diffusion coefficient into Cu than that of Zn are formed.

Furthermore, a method of producing this copper fin material for heat-exchanger of this invention is characterized in that, after an alloy film comprising elements with a lower diffusion coefficient into Cu than that of Zn and Zn was formed on the surface of Cu or Cu alloy strip, the diffusion treatment is given under heat so that, on the surface of Cu or Cu alloy strip, an inner side diffused layer comprising Cu and Zn and a surface side diffused layer being provided on the surface side thereof and comprising Cu, Zn and elements with a lower diffusion coefficient into Cu than that of Zn are formed, or the diffusion treatment under heat and the rolling processing are given.

Still more another method of producing the fin material of the invention is characterized in that, after an alloy film comprising elements with a lower diffusion coefficient into Cu than that of Zn and Zn was formed on the surface of heat-resisting copper strip containing one or more of the group consisting of Mg, Zn, Sn, Cd, Ag, Ni, P, Zr, Cr, Pb and Al in total amounts of 0.01 to 0.13 wt. %, the remainder being Cu, and having an electroconductivity of not lower than 90% IACS, the diffusion treatment is given under heat so that, on the surface of said heat-resisting copper strip, an inner side diffused layer comprising Cu and Zn and a surface side diffused layer being provided on the surface side thereof and comprising Cu, Zn and elements with a lower diffusion coefficient into Cu than that of Zn are formed, or the diffusion treatment under heat and the rolling processing are given.

And, in either case above, it is desirable to use at least one of Ni, Al, Sn and Co as the elements with a lower diffusion coefficient into Cu than that of Zn, and Ni is desirable above all for reasons including the management of covering thickness and alloy composition etc. in addition to the relatively easy cover ability. With respect to Ni, it is particularly effective to cover the surface of Cu or Cu alloy strip or heat-resisting copper strip as described above with . Zn-Ni alloy with a Ni content of 6 to 18 wt. % in a thickness B such that Zn-Ni alloy thickness B divided by the total thickness A of the covered strip is in the equation (1) and to give the diffusion treatment under heat or the diffusion treatment under heat and the rolling processing so that the Zn concentration of the diffused layer formed finally on the surface is made to be 10 to 42 wt. %.

$$B/A = 0.03\text{–}0.14 \quad (1)$$

DETAILED DESCRIPTION OF THE INVENTION

Figure 1:
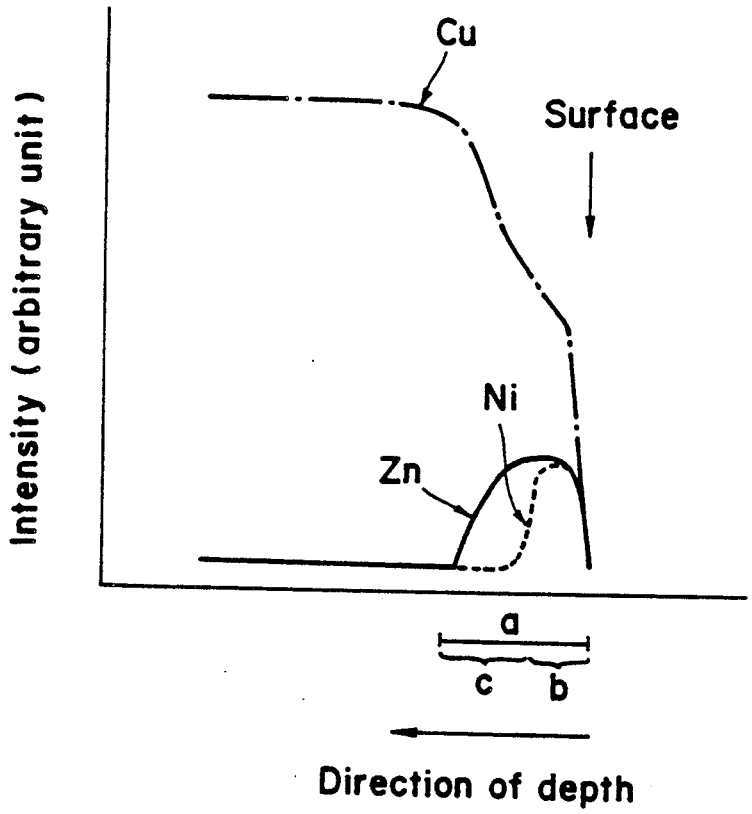
FIG. 1 is a chart showing one example of line analysis along the section of the diffused layer of fin material of the invention by the use of EPMA, wherein a indicates Zn-diffused layer, b indicates Cu-Zn-Ni alloy-diffused layer, and c indicates Cu-Zn alloy-diffused layer.
Figure 2:
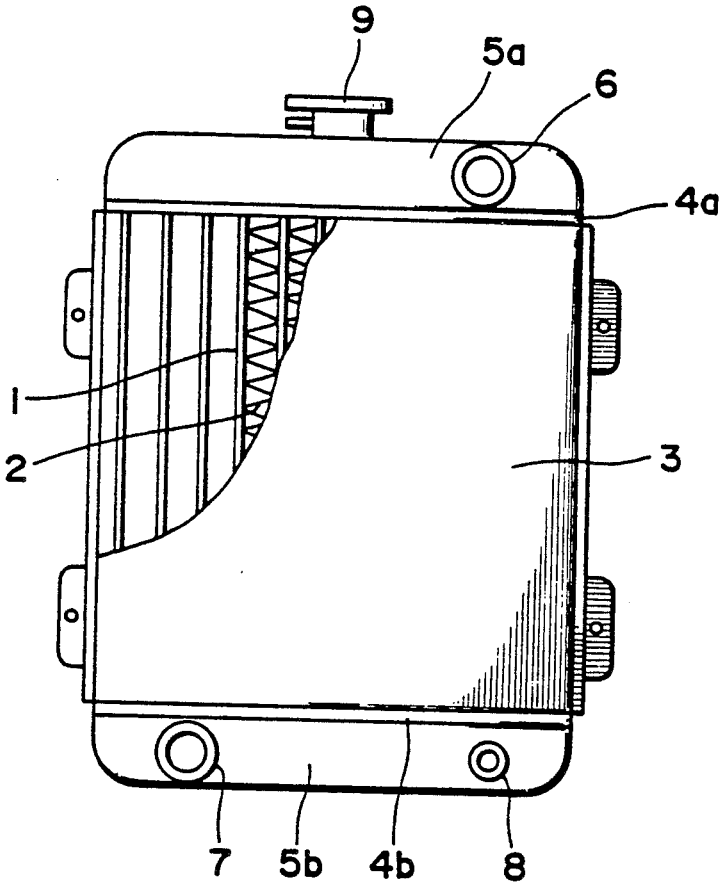
FIG. 2 shows one example of radiator for cars, wherein 1 indicates a tube, 2 indicates a fin, 3 indicates a core, 4*a* and 4*b* indicate seat plates, and 5*a* and 5*b* indicate a tank.

According to the invention, after an alloy film comprising Zn and an element (X) with a lower diffusion coefficient into Cu than that of Zn excellent in the corrosion resistance is formed on the surface of Cu or Cu alloy, the diffusion treatment is given under heat so that, by utilizing the difference in the diffusion velocity into Cu, a surface side diffused layer comprising Cu-Zn-X alloy containing the element X with a lower diffusion velocity into Cu than that of Zn is formed on the surface side and further an inner side diffused layer comprising Cu-Zn alloy is formed for underneath layer. By providing two diffused layers in this fashion, the dezincificative corrosion of surface is alleviated, the decrease in the electroconductivity arising from the addition of sufficient amount of element X to suppress and prevent effectively the dezincificative corrosion is kept to a low degree by retaining the element X on the surface side instead of allowing it to distribute throughout both diffused layers, and, at the same time, the inside Cu or Cu alloy is protected through the effect of Zn in a mode of sacrificial anode.

The reason why at least one of Ni, Co, Sn and Al were used as elements X with a slower diffusion velocity into Cu than that of Zn is due to that the formation of Zn alloy film containing not less than about 6 wt. % of iron group elements such as Ni and Co by hot-dipping process needs a high temperature of higher than about 700° C., which is very difficult industrially and impractical, but the iron group elements and Zn can form relatively easily a film plated with alloy thereof by electroplating process as an extraordinary eutectoid type alloy plating wherein potentially base Zn deposits preferentially in spite of the potential difference therebetween.

Also, with respect to Sn and Al, the reasons are due to that, in the case of Sn, the formation of Zn-Sn alloy film is possible also industrially by both electroplating process and hot-dipping process and, in the case of Al, the formation of film plated with Zn-Al alloy is difficult by electroplating process, but it is relatively easy by hot-dipping process etc.

Moreover, when forming any alloy film, publicly known covering processes such as flame spray coating and PVD can be used except the processes aforementioned.

In following, the explanation will be made restricting X to Ni.

As a process for covering with Zn-Ni alloy, the electroplating process is advantageous industrially, and, if the plating bath and the plating conditions are such that the Ni content in the film plated with Zn-Ni alloy becomes 6 to 18 wt. %, any of sulfate bath, chloride bath, mixed bath of sulfate with chloride, sulfamine bath, etc. can be used.

The reason why the Ni content was made to be 6 to 18 wt. % is because of that a form mainly composed of $\partial$ phase excellent in the corrosion resistance starts to appear at a Ni content of not less than 6 wt. % and approximately single phase of $\partial$ phase completes at more than about 10 wt. % to improve the corrosion resistance, but, under 6 wt. %, the improvement effect on the corrosion resistance is little or slight, if any, resulting in the merit of plating with Zn-Ni alloy being offset by the economical disadvantage of using expensive Ni. Moreover, the reason of being made to be not more than 18 wt. % is because further improvement in the corrosion resistance cannot be expected by increasing the Ni content more than this level, and the increase in the amount of expensive Ni brings about the corresponding economical disadvantage. Thus, preferably, a Ni content of 10 to 15 wt. % is desirable.

The diffusion treatment under heat after the plating with Zn-Ni alloy is for the reasons of that the adhesion between the plated layer and the Cu or Cu alloy strip is strengthened through the mutual diffusion between both and, at the same time, by utilizing the difference in the diffusion velocity into Cu between Zn and Ni (Zn is faster than Ni), part of Zn is replaced with Cu while retaining the form of Zn-Ni $\partial$ phase to make the surface side of diffused layer a highly corrosion-resisting Cu-Zn-Ni alloy layer and the underneath layer thereof a Cu-Zn alloy layer, thus forming two diffused layers, thereby both sacrificial anode effect and high corrosion resistance are provided to the fin material.

The Zn concentration in the surface side diffused layer was made to be 10 to 42 wt. due to the following reasons. In the case of diffused fin material plated with Zn-Ni alloy, the plating thickness on both sides/core material (covering index) is desirable to be 0.04 to 0.11 or so from the balance between the improvement effect on the corrosion resistance and the electroconductivity. Moreover, the plate thickness at the time of being used finally as a fin material for heat-exchanger is generally 30 to 45 $\mu$m or so. Considering these facts, the diffusion becomes excess and the decrease in the electroconductivity becames too large, if the diffusion treatment is given so that the amount of Zn become under 10 wt. %. Also, corrosion resistance is poorer than that of one with a Zn concentration of 10 wt. % in the surface of diffused layer, if the plating thickness and the covering index are equal. In the case of diffusion treatment so as to exceed 42 wt. %, the diffusion becomes deficient and the solderability, rolling property, etc. become poor, though the problem of electroconductivity disappears particularly. Also, the corrosion resistance becomes poorer than that of one with a Zn concentration of 42 wt. % in the surface side diffused layer, if the plating thickness and the covering index are equal.

The reason why B/A was prescribed within a range of equation (1) as described above is due to that, if B/A is under 0.03, the small decrease in the electroconductivity is good, but the improvement effect on the corrosion resistance is hardly seen resulting in the merit of plating with Zn-Ni alloy being offset by the economical disadvantage of using expensive Ni. Further, if B/A exceeds 0.14, sufficient effect is seen for the improvement in the corrosion resistance, but a drastic decrease in the electroconductivity is brought about. This particularly results in an unsuitable fin material for heat-exchanger for cars. In addition, an increase in the weight of expensive Ni brings the economical disadvantage. Preferably, the value of B/A is desirable to be within a range of 0.045 to 0.10.

Furthermore, the rolling processing improves the adhesion. Combined with the diffusion under heat, it enhances the accuracy of dimensions and makes the plated layer a processed texture, thereby improving the strength of fin material. Either the diffusion treatment under heat or the rolling processing may be given first to achieve the effect of the invention, but the rolling processing is desirable to be given at the final process.

The temperature for the diffusion treatment is desirable to be 300° to 700° C. or so, though it depends on the treatment time.

| Plating bath No. | 1 | 2 | 3 | 4 | 5 | 6 | 7 | 8 | 9 | 10 | 11 | 12 | 13 |
|---|---|---|---|---|---|---|---|---|---|---|---|---|---|
| $NiSO_4.6H_2O$* | 300 | — | 300 | 80 | 50 | 300 | 300 | 80 | 300 | 300 | 280 | — | — |
| $NiCl_2.6H_2O$* | — | 180 | — | — | — | — | — | — | — | — | — | — | — |
| $ZnSO_4.7H_2O$* | 80 | — | 250 | 240 | 250 | 20 | 80 | 220 | 80 | 200 | 80 | 250 | — |
| $ZnCl_2$* | — | 80 | — | — | — | — | — | — | — | — | — | — | — |
| $Na_2SO_4$* | 100 | — | 100 | 100 | 100 | 100 | 100 | 100 | 100 | 100 | 100 | 100 | — |
| $Al_2(SO_4)_3.14$-18 $H_2O$* | 30 | — | 30 | 30 | 30 | 30 | 30 | 30 | 30 | 30 | 30 | 30 | — |
| $NH_4Cl$* | — | 230 | — | — | — | — | — | — | — | — | — | — | — |
| $H_3BO_3$* | — | 20 | — | — | — | — | — | — | — | — | — | — | — |
| $Zn(CN)_2$* | — | — | — | — | — | — | — | — | — | — | — | — | 14.5 |
| $Na_2Sn(OH)_6$* | — | — | — | — | — | — | — | — | — | — | — | — | 67 |
| NaCN* | — | — | — | — | — | — | — | — | — | — | — | — | 30 |
| PH | 2.5 | 5.0 | 2.0 | 1.5 | 1.5 | 1.5 | 2.5 | 1.5 | 1.5 | 2.5 | 2.0 | 1.5 | — |
| Temperature (°C.) | 50 | 30 | 50 | 50 | 50 | 50 | 50 | 50 | 50 | 50 | 50 | 50 | 65 |
| Current density ($A/dm^2$) | 5 | 5 | 35 | 5 | 5 | 5 | 35 | 5 | 5 | 35 | 5 | 5 | 3 |

*g/L

EXAMPLE 1

Employing the plating baths No. (1), (2), (3), (4), (5), (6) and (12) shown in Table 1, the plating with Zn-Ni alloy in a thickness of 2.4 μm was given on to the both sides of heat-resisting copper strips (electroconductivity: 95.5 % IACS) with a thickness of 0.065 mm, which contain 0.02 wt. % of Mg. Then, these were submitted to the diffusion treatment under heat for 1 minute at 500° C. and further to the rolling processing to obtain fin materials with a thickness of 0.036 mm. Of these, the corrosion test was performed and the deterioration rate in the tensile strength was determined. The results were compared with those of one produced in such a way that, after plating with pure Zn in a thickness of 2.4 μm, the diffusion treatment under heat was performed for 1 minute at 450° C. and then the thickness was made to be 0.036 mm by the rolling processing, which are shown in Table 2.

For the corrosion test, such procedure that, after the spraying with saline solution according to JIS Z2371 had been performed for 1 hour, the fin material was kept in a thermohygrostatic oven of a temperature of 70° C. and a humidity of 95 % for 23 hours, and was repeated 30 times.

TABLE 2

| Fin material | No. | Ni content in plated layer (wt. %) | Electroconductivity (% IACS) | Deterioration rate in strength (%) | External appearance after corrosion test | Remarks |
|---|---|---|---|---|---|---|
| Fin material of invention | 1 | 13.7 | 82.4 | 31.7 | Dezincification slight | Plating bath |
| Fin material of invention | 2 | 10.1 | 83.0 | 32.4 | Dezincification slight | Plating bath 2 |
| Fin material of invention | 3 | 11.7 | 82.4 | 32.1 | Dezincification slight | Plating bath 3 |
| Fin material of invention | 4 | 6.3 | 83.6 | 42.1 | Dezincification medium | Plating bath 4 |
| Comparative fin material | 5 | 5.0 | 83.8 | 51.2 | Dezincification heavy | Plating bath 5 |
| Comparative fin material | 6 | 22.5 | 81.2 | 32.0 | Dezincification slight | Plating bath 6 |
| Comparative fin material | 7 | 0 | 85.2 | 55.9 | Overall dezincification | Plating bath 12 |

As evident from Table 2, it can be seen that the comparative fin material No. 7, the diffusion under heat and the rolling processing being given after the plating with pure Zn shows a marked dezincification and a high deterioration in strength, whereas the fin materials No. 1 through 4 of the invention show a slight dezincification and a low deterioration in strength in all cases.

On the contrary, with the comparative fin material No. 5, the Ni content in plated film being less, than 6.0 wt. % the dezincification is remarkable and the deterioration in strength is high. Also, with the comparative fin material No.6, the Ni content being over the upper limit of 18 wt. %, any additional improvement effect on the corrosion resistance cannot be recognized and an increased use of Ni is linked with cost up leading to the disadvantage.

EXAMPLE 2

Employing the plating baths No. (1), (5), (6), (7) and (8) shown in Table 1, the plating with Zn-Ni alloy was given on to the both sides of heat resisting copper strips (electroconductivity: 95% IACS) with a thickness of 0.065 mm which contain 0.02 wt. % of Mg, and then these were submitted to the diffusion treatment under heat at 300° to 600° C. to produce specimens having various Zn concentrations in the surface of diffused layer. These were further submitted to the rolling processing to obtain fin materials with a thickness of 0.036 mm. Of these, the corrosion test was performed and the velocity of corrosion was determined. The results are shown in Table 3.

For the corrosion test, such procedure that, after the spraying with saline solution according to JIS Z2371 had been performed for 1 hour, the fin material was kept for 30 minutes in a thermostatic oven of a humidity of 30% and further it was kept in a thermohygrostatic oven of temperature of 70° C. and a humidity of 95% for 22.5 hours, and was repeated 30 times. Thereafter, only the corrosion products were dissolved and removed with dilute solution of sulfuric acid and the corrosion loss was determined from the weights before and after the corrosion test.

TABLE 3

| Fin material | No. | Ni content in plated film (wt. %) | Covering index (%) | Zn concentration in the surface of diffused layer (%) | Velocity of corrosion (mg/dm²/day) | Electroconductivity (%) | Solderability | Rolling property | External appearance after corrosion test | Remarks |
|---|---|---|---|---|---|---|---|---|---|---|
| Fin material of invention | 8 | 6.7 | 4.6 | 20.1 | 6.4 | 82.5 | | | Dezincification medium | Plating bath 8 |
| Fin material of invention | 9 | 6.5 | 6.8 | 30.3 | 6.0 | 83.5 | | | Dezincification medium | Plating bath 8 |
| Fin material of invention | 10 | 10.9 | 4.6 | 25.3 | 5.0 | 84.2 | | | Dezincification slight | Plating bath 7 |
| Fin material of invention | 11 | 10.6 | 6.8 | 40.8 | 5.6 | 85.4 | | | Dezincification slight | Plating bath 7 |
| Fin material of invention | 12 | 13.7 | 4.6 | 14.3 | 7.7 | 79.9 | | | Dezincification slight | Plating bath 1 |
| Fin material of invention | 13 | 13.7 | 6.8 | 35.0 | 4.7 | 84.3 | | | Dezincification slight | Plating bath 1 |
| Comparative fin material | 14 | 10.6 | 4.6 | 9.0 | 9.4 | 70.1 | | | Dezincification slight | Plating bath 7 |
| Comparative fin material | 15 | 10.6 | 6.8 | 45.3 | 6.9 | 86.2 | X | X partial crock | Dezincification slight | Plating bath 7 |
| Comparative fin material | 16 | 4.9 | 4.6 | 30.3 | 10.8 | 85.4 | | | Dezincification heavy | Plating bath 5 |
| Comparative fin material | 17 | 22 | 4.6 | 30.0 | 5.9 | 84.7 | | | Dezincification slight | Plating bath 6 |

As evident from Table 3, it can be seen that the comparative fin material No.16, the Ni content in the plated film being under the lower limit of 6 wt. % despite the Zn concentration in the surface of diffused layer being within a range of 10 to 42 wt. %, the dezincificative corrosion, occurs thus it shows a large corrosion loss and is poor in the corrosion resistance. Whereas, with the fin materials No.8 through 13 of the invention, the Zn concentration in the surface of diffused layer being within a range of 10 to 42 wt. % and the Ni content in the plated film being within a range of 6 to 18 wt. %, the improvement in the corrosion can be seen.

Moreover, with the comparative fin material No. 14, the Zn concentration in the surface side diffused layer being under the lower limit of 10 wt. % due to the excess diffusion despite the Ni content in the plated film being within a range of 6 to 18 wt. %, the decrease in the electroconductivity is high and the corrosion loss is also large showing the poor corrosion resistance. Furthermore, with the comparative fin material No. 15, the Zn concentration in the surface of diffused layer being over the upper limit of 42 wt. %, there arise problems that the solderability becomes poor and that the cracks are caused partially during the rolling, and the like.

On the other hand, in the case of the comparative fin material No.17, the Ni content in the diffused layer being over 18 wt. %, any additional improvement in the corrosion resistance cannot be recognized and an increased use of Ni is linked with cost increase leading to the economical disadvantage.

EXAMPLE 3

Employing the plating baths No. (1), (2), (4), (5), (6), (9), (10) and (12) shown in Table 1, the plating with Zn-Ni alloy was given on to the both sides of heat-resisting copper strips (electroconductivity: 95.5% IACS) with a thickness of 0.065 mm, which contain 0.02 wt. % of Mg so as to make various ratios of B/A. Then, these were submitted to the diffusion treatment under heat and thereafter to the rolling processing to produce fin materials No. 18 through 28 with a thickness of 0.036 mm, which are shown in Table 4.

Of these, the electroconductivity was measured and, after the corrosion test similar to that in Example 1, the deterioration rate in the tensile strength was determined. These results were compared with the measurement results of a fin material with a thickness of 0.036 mm produced by a comparative method No. 34, that is, in such a way that, after plating with pure Zn in a thickness of 2.4 μm onto the surface of said heat-resisting copper strip, the diffusion treatment under heat and thereafter the rolling processing were performed, respectively, which are put down in Table 4.

TABLE 4

| Fin material | No. | Ni content in plated layer (wt. %) | B/A | Conditions of diffusion treatment under heat | Electro-conduc-tivity (%) | Deterioration rate in strength (%) | External appearance after corrosion test | Plating bath used No. |
|---|---|---|---|---|---|---|---|---|
| Fin material of invention | 18 | 13.7 | 0.11 | 500° C. × 10 min | 82.0 | 30.2 | Dezincification slight | 9 |
| Fin material of invention | 19 | 12.0 | 0.06 | 500° C. × 5 min | 83.5 | 33.6 | Dezincification slight | 10 |
| Fin material of invention | 20 | 13.7 | 0.04 | 500° C. × 1 min | 85.1 | 43.2 | Dezincification medium | 9 |
| Fin material of invention | 21 | 12.0 | 0.04 | 500° C. × 1 min | 84.8 | 42.7 | Dezincification medium | 10 |
| Fin material of invention | 22 | 13.7 | 0.04 | 500° C. × 1 min | 84.8 | 42.1 | Dezincification medium | 1 |
| Fin material of invention | 23 | 12.0 | 0.04 | 500° C. × 1 min | 85.1 | 42.5 | Dezincification medium | 10 |
| Fin material of invention | 24 | 6.5 | 0.06 | 500° C. × 5 min | 83.6 | 41.3 | Dezincification medium | 4 |
| Fin material of invention | 25 | 10.3 | 0.07 | 500° C. × 5 min | 83.2 | 31.2 | Dezincification slight | 2 |
| Fin material of invention | 26 | 10.3 | 0.08 | 500° C. × 5 min | 82.9 | 30.4 | Dezincification slight | 2 |
| Fin material of invention | 27 | 13.7 | 0.10 | 550° C. × 10 min | 82.4 | 30.0 | Dezincification slight | 1 |
| Fin material of invention | 28 | 6.5 | 0.12 | 550° C. × 10 min | 81.1 | 36.1 | Dezincification slight | 4 |
| Comparative fin material | 29 | 12.0 | 0.17 | 550° C. × 10 min | 75.2 | 30.0 | Dezincification slight | 10 |
| Comparative fin material | 30 | 13.7 | 0.02 | 500° C. × 1 min | 86.4 | 57.1 | Dezincification heavy | 9 |
| Comparative fin material | 31 | 4.9 | 0.06 | 500° C. × 5 min | 84.9 | 51.8 | Dezincification heavy | 5 |
| Comparative fin material | 32 | 22.1 | 0.06 | 500° C. × 5 min | 82.0 | 32.6 | Dezincification slight | 6 |
| Comparative fin material | 33 | 13.7 | 0.02 | 500° C. × 1 min | 86.4 | 56.2 | Dezincification slight | 1 |
| Comparative fin material | 34 | 0 | — | 450° C. × 1 min | 85.2 | 55.6 | Overall dezincification | |

As evident from Table 4, the comparative fin material No. 34, the diffusion treatment under heat and the rolling processing being added thereto after plating with pure Zn, exhibits a marked dezincification and a high deterioration in strength. It can be sen however that, with the fin materials No. 18 through 28 of the invention, the dezincification is light and the deterioration in strength is low.

On the contrary, with the comparative fin material No. 31, the Ni content being under 6 wt. % despite the B/A ratio being within a prescribed range, the deterioration in strength is severe, and, on the other hand, with the comparative fin material No. 32, the Ni content being over 18 wt. %, not only cannot any additional improvement in the corrosion resistance be recognized, but also an increased Ni content leads to the disadvantage in cost.

Moreover, the comparative fin materials No. 30 and No. 33, the B/A ratio being under 0.03 despite the Ni content being within a prescribed range, show a marked deterioration in strength.

In the case of comparative fin material No. 29, said ratio being over 0.14, additional improvement in the corrosion resistance is not seen; further the decrease in the electroconductivity becomes high, and the increased weight is connected with increased cost leading to the economical disadvantage.

EXAMPLE 4

An electric copper was molten using a high-frequency melting furnace while covering the surface of melt with charcoal. Adding predetermined elements to this, homogeneous alloy melts were prepared to cast into ingots with compositions shown in Table 5. After the surface was shaven by 2.5 mm these ingots were heated for 1 hour at 850° C. and rolled to a thickness of 10 mm by the hot rolling. With these, the cold rolling and the annealing were repeated to obtain prime strips with a thickness of 0.035 mm.

Next, employing the plating baths No. (11) and (13) under the conditions shown in Table 1 and combining these prime strips with either of plating baths as shown in Table 5, the plating with Zn-Ni alloy or Zn-Sn alloy in a thickness of 1.2 μm, the compositions of which are shown in Table 5, was given and then the diffusion treatment under heat was performed for 5 minutes at 350° C. Of these fin materials (No. 35 through No.44), the hardness against heat and the electroconductivity were determined. Moreover, the corrosion test similar to that in Example 1 was performed to measure the deterioration rate in the tensile strength and to evaluate the degree of dezincification by the observation of external appearance.

These results are shown in Table 5 together with the measurement results as above of fin materials (No. 45 through No. 47), which were produced in such a way that, after plating the prime strips aforementioned with pure Zn in a thickness of 1.2 μm in the plating bath No. (12), these were submitted to the diffusion treatment under heat for 5 minutes at 350° C.

TABLE 5

| | | Characteristics of prime strip before plating | | | Characteristics of fin material after diffusion treatment under heat | | | | | |
|---|---|---|---|---|---|---|---|---|---|---|
| | | Chemical composition (%) | | Electro-conduc-tivity | | Hardness against heat | Electro-conduc-tivity | Deterior-ation rate in strength after corrosion | External appearance after corrosion | Plating bath No. |
| Fin material | No. | Cu | Additional element | (% IACS) | Composition of film | (Hv) | (% IACS) | test (%) | test | applied |
| Fin material invention | 35 | Bal-ance | Zr 0.03, P 0.02 | 93 | Zn-11.8% Ni | 112 | 83.6 | 31.4 | Dezinc-ification slight | 11 |
| Fin material invention | 36 | Bal-ance | Cr 0.02, Sn 0.02 | 92 | Zn-49.8% Sn | 104 | 82.0 | 37.6 | Dezinc-ification slight | 13 |
| Fin material invention | 37 | Bal-ance | Mg 0.03 | 97 | Zn-12.6% Ni | 107 | 86.0 | 32.5 | Dezinc-ification slight | 11 |
| Fin material invention | 38 | Bal-ance | Ag 0.1 | 98 | Zn-50.4% Sn | 118 | 87.6 | 38.3 | Dezinc-ification slight | 13 |
| Fin material invention | 39 | Bal-ance | Pb 0.03, Sn 0.01 | 94 | Zn-11.9% Ni | 105 | 83.9 | 33.0 | Dezinc-ification slight | 11 |
| Fin material invention | 40 | Bal-ance | P 0.01, Mg 0.02 Zn 0.01 | 91 | Zn-12.2% Ni | 117 | 80.0 | 31.9 | Dezinc-ification slight | 11 |
| Fin material invention | 41 | Bal-ance | Ni 0.01, P 0.02 | 93 | Zn-51.0% Sn | 110 | 81.7 | 37.4 | Dezinc-ification slight | 13 |
| Comparative fin material | 42 | Bal-ance | Cr 0.005, Sn 0.003 | 98 | Zn-12.3% Ni | 71 | 86.4 | 33.1 | Dezinc-ification slight | 11 |
| Comparative fin material | 43 | Bal-ance | Zr 0.005 | 98 | Zn-11.9% Ni | 80 | 87.0 | 32.0 | Dezinc-ification slight | 11 |
| Comparative fin material | 44 | Bal-ance | Cr 0.10, P 0.02, Sn 0.05 | 79 | Zn-12.4% Ni | 120 | 68.7 | 31.8 | Dezinc-ification slight | 11 |
| Comparative fin material | 45 | Bal-ance | Mg 0.03, Zn 0.01 | 95 | 100% Zn | 109 | 86.3 | 56.1 | overall dezinc-ification | 12 |
| Comparative fin material | 46 | Bal-ance | Mg 0.03 | 97 | 100% Zn | 107 | 86.2 | 57.6 | overall dezinc-ification | 12 |
| Comparative fin material | 47 | Bal-ance | Ag 0.1 | 98 | 100% Zn | 118 | 87.4 | 56.2 | overall dezinc-ification | 12 |

Further, of the material of the invention, the plating with Zn-Ni alloy being given and the diffusion treatment under heat being performed for 30 minutes at 350° C., one example of results obtained by conducting line analysis along the section of diffused layer by the use of EPMA is shown in FIG. 1.

Besides, the hardness against heat in Table 5 shows the results obtained through the measurement of Vickers hardness (hv) after the diffusion treatment under heat for 5 minutes at 350° C.

As evident from Table 5, it can be seen that, with the comparative fin materials No. 45 through 47 plated with pure Zn, the dezincification in surface is remarkable and the deterioration in strength due to corrosion is conspicuous, whereas, with the fin materials No. 35 through 41 of the invention, the dezincification after the corrosion test is slight, the deterioration in strength is low, and the corrosion resistance is improved.

Further, it can be seen that the fin materials No. 35 through 41 of the invention have both excellent heat resistance and excellent electroconductivity together with said corrosion resistance, but the comparative examples No. 42 through 44, the chemical ingredients of prime strips as base materials being out of prescribed range, have either poor heat resistance or poor electroconductivity.

Moreover, as evident from FIG. 1, it can be observed that the Zn-diffused layer (a) formed in the surface layer of the fin material of the invention plated with Zn-Ni alloy consists of two layers: the first being Cu-Zn-Ni alloy-diffused layer (b) on the surface side, and the second being Cu-Zn alloy-diffused layer (c) on the inner side thereof.

EXAMPLE 5

The ingots having same compositions as those of ingots casted in Example 4, the compositions of which are shown in Table 6, were processed similarly to Example 4 to obtain prime strips with a thickness of 0.065 mm.

Films plated with either Zn-Ni alloy or Zn-Sn alloy in a thickness of 2.4 μm per side, the compositions of which are shown in Table 6, were formed on both sides of these prime strips employing the plating bath No. (11) or (13) in Table 1, or films with Zn-10 % Al alloy in a thickness of 4 μm per side were formed by hot dipping method. Then, the strips were submitted to the diffusion treatment under heat for 1 minute at 500° C. and thereafter to the rolling processing to produce the fin materials (No.48 through 62) with a thickness of 0.036 mm.

Of these, the hardness against heat and the electroconductivity were determined and the same tests as in Example 4 were conducted to measure the deterioration rate in the tensile strength and to evaluate the degree of dezincification by observing the external appearance. These results are shown in Table 6 together with the measurement results of comparative fin materials (No.60 through 62) after the corrosion test with a thickness of 0.036 mm, which were produced in such a way that, after plating the primer strips with pure Zn in a thickness of 2.4 μm per side in the plating bath No. (12) aforementioned, these were submitted to the diffusion treatment under heat for 1 minute at 450° C. and thereafter to the rolling processing.

comparative fin materials No. 60 through 62, the plating with 100% Zn being given, the corrosion resistance is decreased.

EXAMPLE 6

Applying the plating baths No. (11), (12) and (13) shown in Table 1 as shown in Table 7, both sides of heat-conducting copper strips (electroconductivity: 95.5 %) with a thickness of 0.035 mm, which contain 0.02 wt. % of Mg were plated with Zn-Ni alloy or Zn-Sn alloy in a thickness of 1.2 μm and then these were submitted to the diffusion treatment under heat for 30 minutes at 350° C. to produce the fin materials of the invention.

TABLE 6

| | | Characteristics of prime strip before plating | | | Characteristics of fin material after diffusion treatment under heat | | | | | |
|---|---|---|---|---|---|---|---|---|---|---|
| | | Chemical composition (%) | | Electro-conductivity | | | | Deterioration rate | External | |
| Fin material | No. | Cu | Additional element | (% IACS) | Composition of film | Hardness against heat (Hv) | Electro-conductivity (% IACS) | in strength after corrosion test (%) | appearance after corrosion test | Plating bath No. applied |
| Fin material invention | 48 | Balance | Zr 0.03, P 0.02 | 93 | Zn-11.6% Ni | 112 | 82.0 | 30.7 | Dezincification slight | 11 |
| Fin material invention | 49 | Balance | Cr 0.02, Sn 0.02 | 92 | Zn-50.0% Sn | 104 | 80.3 | 36.8 | Dezincification slight | 13 |
| Fin material invention | 50 | Balance | Mg 0.03 | 97 | Zn-12.3% Ni | 107 | 83.9 | 33.2 | Dezincification slight | 11 |
| Fin material invention | 51 | Balance | Mg 0.03 | 97 | Zn-10.2% Al | 107 | 82.8 | 29.5 | Dezincification slight | Hot dipping |
| Fin material invention | 52 | Balance | Ag 0.1 | 98 | Zn-49.7% Sn | 118 | 84.9 | 37.0 | Dezincification slight | 13 |
| Fin material invention | 53 | Balance | Ag 0.1 | 98 | Zn-10.2% Al | 118 | 82.3 | 30.0 | Dezincification slight | Hot dipping |
| Fin material invention | 54 | Balance | Pb 0.03, Sn 0.01 | 94 | Zn-12.0% Ni | 105 | 81.9 | 32.1 | Dezincification slight | 11 |
| Fin material invention | 55 | Balance | P 0.01, Mg 0.02, Zn 0.01 | 91 | Zn-11.8% Ni | 117 | 78.0 | 32.3 | Dezincification slight | 11 |
| Fin material invention | 56 | Balance | Ni 0.01, P 0.02 | 93 | Zn-50.3% Sn | 110 | 80.3 | 37.1 | Dezincification slight | 13 |
| Comparative fin material | 57 | Balance | Cr 0.005, Sn 0.003 | 98 | Zn-12.4% Ni | 71 | 84.1 | 33.3 | Dezincification slight | 11 |
| Comparative fin material | 58 | Balance | Zr 0.005 | 98 | Zn-12.5% Ni | 80 | 84.6 | 31.9 | Dezincification slight | 11 |
| Comparative fin material | 59 | Balance | Cr 0.10, P 0.02, Sn 0.05 | 79 | Zn-12.0% Ni | 120 | 66.2 | 32.4 | Dezincification slight | 11 |
| Comparative fin material | 60 | Balance | Mg 0.03, Zn 0.01 | 95 | 100% Zn | 109 | 85.9 | 58.0 | Overall dezincification | 12 |
| Comparative fin material | 61 | Balance | Mg 0.03 | 97 | 100% Zn | 107 | 85.9 | 56.3 | Overall dezincification | 12 |
| Comparative fin material | 62 | Balance | Ag 0.1 | 98 | 100% Zn | 118 | 86.3 | 55.9 | Overall dezincification | 12 |

As evident from Table 6, it can be seen that, with the fin materials No.48 through 56 of the invention both the heat resistance and the electroconductivity are excellent together with the corrosion resistance, but, with the comparative fin materials No. 57 through 59, the chemical compositions of prime strips as base materials being out of the prescribed range, either the heat resistance or the electroconductivity is poor, and, with all of the Of these, the corrosion test similar to that in Example 1 was performed and the deterioration rate in the tensile strength was measured. The results were compared with those of comparative fin material produced in such a way that, after plating with pure Zn in a thickness of 1.2 μm in the plating bath No. (12) shown in Table 1, this was submitted to the diffusion treatment for 30 minutes at 350° C., which are shown in Table 7.

TABLE 7

| Fin material | No. | Composition of plated film | Characteristics of fin material after diffusion treatment under heat: Electro-conductivity (% IACS) | Deterioration rate in strength after corrosion test (%) | External appearance after corrosion test | Plating bath No. applied |
|---|---|---|---|---|---|---|
| Fin material of invention | 63 | Zn-12.1% Ni | 83.4 | 31.2 | Dezincification slight | 11 |
| Fin material of invention | 64 | ZN-51.2% Sn | 83.1 | 37.4 | Dezincification slight | 13 |
| Comparative fin material | 65 | 100% Zn | 85.8 | 56.1 | Overall dezinc-ification | 12 |

As evident from Table 7, it can be seen that the comparative fin material No. 65 plated with pure Zn exhibits a marked deterioration in strength due to the corrosion, whereas, the fin materials No. 63 and 64 of the invention show a low deterioration in strength and an improved corrosion resistance.

EXAMPLE 7

Next, employing the plating baths No. (11) and (13) aforementioned, both sides of heat-conducting copper strips (electroconductivity: 95.5%) with a thickness of 0.065 mm, which contain 0.02 wt. % of Mg were plated with Zn-Ni alloy or Zn-Sn alloy in a thickness of 2.4 μm and then these were submitted to the diffusion treatment under heat for 1 minute of 500° C. and to the rolling processing to obtain the fin materials (No. 66 and 67) of the invention with a thickness of 0.036 mm.

Moreover, a film with Zn-10% Al alloy in a thickness of 4 μm was formed on said heat-resisting copper strip with a thickness of 0.065 mm by the hot dipping method and then this was submitted to the diffusion treatment under heat for 1 minute at 500° C. and to the rolling processing to obtain the fin material (No. 68) of the invention with a thickness of 0.036 mm.

Of these, the corrosion test was performed and the deterioration rate in the tensile strength was measured. The results were compared with those of comparative fin material (No. 69) with a thickness of 0.036 mm produced in such a way that, after plating with pure Zn in a thickness of 2.4 μm in the plating bath No. (12) shown in Table 1, this was submitted to the diffusion treatment for 1 minute at 450° C. and thereafter to the rolling processing, which are shown in Table 8.

TABLE 8

| Fin material | No. | Composition of plated film | Characteristics of fin material after diffusion treatment under heat: Electro-conductivity (% IACS) | Deterioration rate in strength after corrosion test (%) | External appearance after corrosion test | Plating bath No. applied |
|---|---|---|---|---|---|---|
| Fin material of invention | 66 | Zn-11.8% Ni | 82.3 | 32.3 | Dezincification slight | 11 |
| Fin material of invention | 67 | Zn-50.9% Sn | 81.7 | 38.4 | Dezincification slight | 13 |
| Fin material of invention | 68 | Zn-10.1% Al | 81.4 | 37.6 | Dezincification slight | Hot dipping |
| Comparative fin material | 69 | 100% Zn | 85.1 | 55.9 | Overall dezinc-ification | 12 |

As evident from Table 8, it can be seen that, with the comparative fin material No. 69 obtained by plating with pure Zn and then submitting to the diffusion under heat and the rolling processing, the dezincification is remarkable and the deterioration in strength is high, whereas, with the fin material No. 66 through 68 of the invention, the dezincification is light and the deterioration in strength is low.

As described, in accordance with the invention, the corrosion of copper fin material for heat-exchanger is improved effectively and simultaneously the decrease in the thermal conductivity can be suppressed to a low degree. Consequently, the invention exerts industrially such conspicuous effects that the use life as a radiating fin is improved, that the thinning and lightening in weight are made possible, that the fin materials can be utilized also for the electric and electronic components used in corrosive environments, and others.

What is claimed is:

1. A copper fin material for heat-exchanger comprising:
   - a Cu or Cu alloy strip of a base material having a couple of outer surfaces;
   - an inner side diffused layer provided on at least one of said outer surfaces of said base material consisting essentially of Zn alloyed to said Cu or Cu alloy of said base material; and
   - a surface side diffused layer provided on the surface of said inner side diffused layer opposite said base material, comprising Zn and at least one corrosion-resisting element selected from the group consisting of Ni, Al, Sn and Co alloyed to said Cu or Cu alloy of said base material.

2. A copper fin material for heat-exchanger according to claim 1, wherein said corrosion-resisting element is Ni, and the Ni content of said surface side diffused layer is 6–18 wt. %.

3. A copper fin material for heat-exchanger according to claim 1, wherein the Zn concentration of said surface side diffused layer is 10–42 wt. %.

4. A copper fin material for heat-exchanger according to claim 1, wherein said Cu alloy strip contains at least one element selected form the group consisting of Mg, Zn, Sn, Cd, Ag, Ni, P, Zr, Cr, Pb and Al in total amounts of 0.01–0.13 wt. %, and said Cu alloy strip has an electroconductivity of not lower than 90% IACS.

* * * * *